US007286784B2

(12) United States Patent
Tanaka

(10) Patent No.: US 7,286,784 B2
(45) Date of Patent: Oct. 23, 2007

(54) IMAGE FORMING APPARATUS AND PROCESS CARTRIDGE

(75) Inventor: Kenji Tanaka, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 139 days.

(21) Appl. No.: 11/179,487

(22) Filed: Jul. 13, 2005

(65) Prior Publication Data

US 2006/0013605 A1 Jan. 19, 2006

(30) Foreign Application Priority Data

Jul. 15, 2004 (JP) ..... 2004-209004

(51) Int. Cl.
*G03G 21/20* (2006.01)
*G03G 21/10* (2006.01)

(52) U.S. Cl. ..... 399/92; 399/359

(58) Field of Classification Search ..... 399/91, 399/92, 94, 359, 398, 399
See application file for complete search history.

(56) References Cited

U.S. PATENT DOCUMENTS

| | | | | |
|---|---|---|---|---|
| 4,891,678 | A * | 1/1990 | Ishizu et al. | 399/91 |
| 5,392,108 | A * | 2/1995 | DeWaters et al. | 399/399 |
| 6,167,211 | A * | 12/2000 | Oogi et al. | 399/359 X |
| 6,173,132 | B1 * | 1/2001 | Kida et al. | 399/92 X |
| 6,621,554 | B1 * | 9/2003 | Ayash et al. | 399/94 X |
| 6,643,476 | B1 | 11/2003 | Kinouchi et al. | |
| 6,909,864 | B2 * | 6/2005 | Komatsubara | 399/92 |

FOREIGN PATENT DOCUMENTS

JP 2002-189380 A 7/2002

* cited by examiner

*Primary Examiner*—Sandra L. Brase
(74) *Attorney, Agent, or Firm*—Foley & Lardner LLP

(57) ABSTRACT

Between a cleaner frame and a reinforced frame of an image forming unit, a junction duct is formed to flow a airflow from a inlet port to a exhaust port of a main body of an apparatus, a space between a fixing unit and the image forming unit is blocked by the airflow, heating of the image forming unit by radiant heat of a fixing unit is prevented, and by blocking a space between the image forming unit and the image quality is improved and the recycle use of recovered toner is realized.

6 Claims, 4 Drawing Sheets

IMAGE FORMING APPARATUS AND PROCESS CARTRIDGE

FIELD OF THE INVENTION

The present invention relates to an image forming apparatus such as a copier, a printer, etc. and a process cartridge, which prevent temperature rise by airflow in a main body of an image forming apparatus.

DESCRIPTION OF THE BACKGROUND

In electro-photoelectric type image forming apparatus such as a copier, a printer, etc., a fixing unit which clamps and conveys a sheet of paper transferred a toner image formed on a photosensitive unit by fixing rollers having a heat source and heats, presses and fixes the toner image is broadly used. Further, as a result of diversification of image forming apparatus in recent years, an image forming apparatus that is further small in size and light in weight is demanded. And it is tried to make component units themselves of an image forming apparatus small and the conveying passage of sheets of paper short. In order to make the paper conveying passage short, an apparatus to make the transfer and fixing of toner images while conveying sheets of paper supplied from a paper supply unit at the lower side in the vertical direction has been provided.

However, in a small sized apparatus that vertically conveys sheets of paper, a space for vertically conveying sheets of paper at the time of the transfer and fixing is limited and the temperature rise around as fixing unit is unavoidable.

The temperature rise in the vicinity of the fixing unit may affect the charging characteristics of a photo-conductor or the developing characteristics of toner and lower the image quality. In the Japanese Patent Application No. 2002-189380, a configuration of an image forming apparatus to cool the inside of the main body by leading heat generated around a fixing unit or a photosensitive unit to the exhaust port through the clearance of them by a fan for exhausting radiant heat around the fixing unit is disclosed.

However, it is not possible to exhaust the radiant heat generated by a fixing unit directly to the outside of the main body of an image forming apparatus by a fan only as in a conventional apparatus. Furthermore, because a space to separate the photosensitive unit and the fixing unit is narrow, the radiant heat of the fixing unit turns around the photosensitive unit and may heat peripheral units and so. The units around the photosensitive unit may raise their temperatures. The image quality may be lowered for change in the characteristics, when the temperature of the photosensitive unit rises. Or, recovered toner may become inadequate for the recycle for deterioration of the toner characteristics, when the temperature of the cleaner rises.

Therefore, in a small sized image forming apparatus with a limited space for separating a photosensitive unit and a fixing unit, an image forming apparatus and a process cartridge, capable of efficiently exhausting radiant heat of a fixing unit directly to the outside of the apparatus, preventing temperature rise in the vicinity of the photosensitive unit and improving image quality, extending the life of toner by preventing deterioration of its characteristics resulting from the temperature rise, and enabling recycle use of recovered toner are demanded.

SUMMARY OF THE INVENTION

Accordingly, an advantage of the present invention is in a small sized image forming apparatus, to provide an image forming apparatus and a process cartridge capable of efficiently exhausting the radiant heat of a fixing unit directly to the outside of the apparatus, improving the image quality by preventing temperature rise around a photosensitive unit and enabling the recycling use of recovered toner.

To achieve the above advantage, one aspect of the present invention is to provide an image forming apparatus comprising, a main body of the apparatus, an image carrier mounted in the main body of the apparatus, an image forming portion to form a toner image on the image carrier, a transfer unit to transfer the toner image formed on the image carrier to transfer material, a toner recovery unit to recover residual toner on the image carrier after passing the transfer unit, a fixing unit to fix the toner image on the transfer material provided above the image forming unit and the toner recovery unit, a junction duct provided between the toner recovery unit and the fixing unit and flow the airflow from the inlet port to the exhaust port of the main body, and a blowing member to generate the airflow.

DETAILED DESCRIPTION OF THE INVENTION

Figure 1:
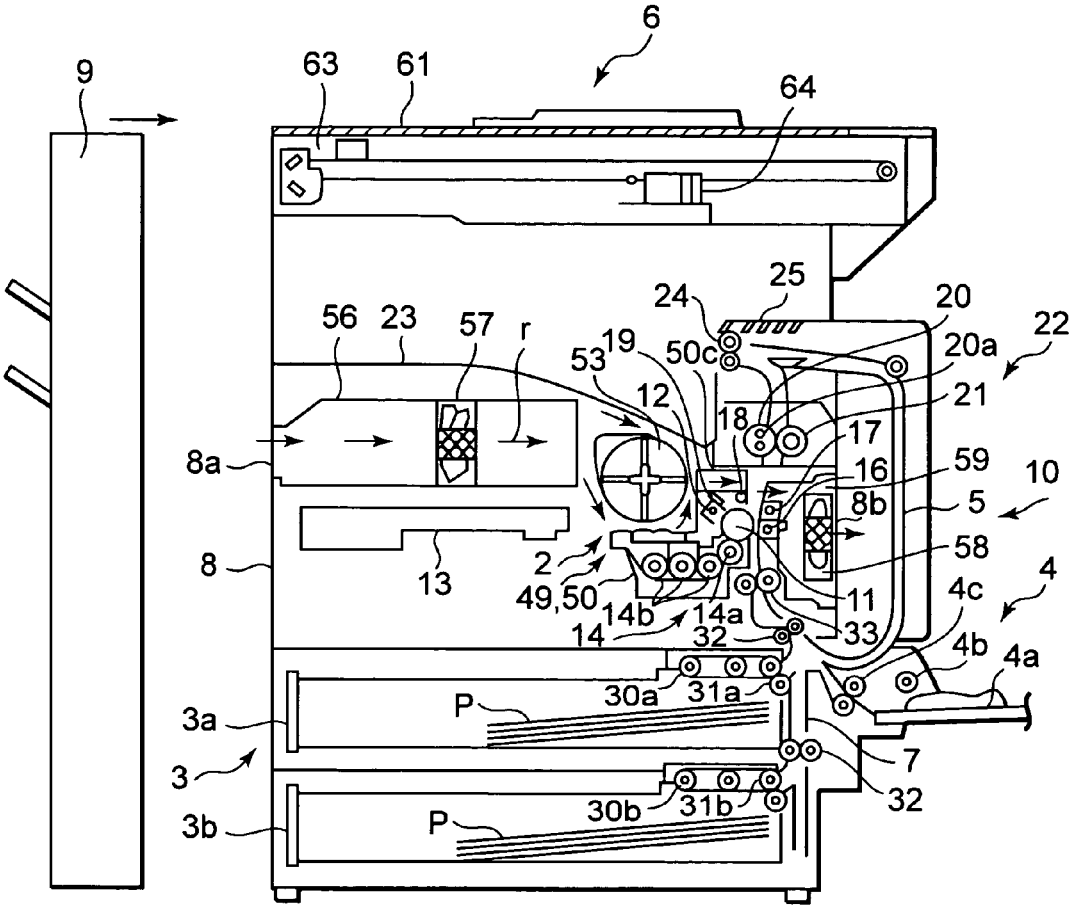
FIG. 1 is a schematic construction diagram showing of a copier in the embodiment of the present invention.

A preferred embodiment of the present invention will be explained in detail with reference to the accompanied drawings. FIG. 1 is a schematic construction diagram showing a copier 10 that is an embodiment of the present invention. The using environment of the copier 10 is set at, for example, below 30° C. The copier 10 mounts a cassette mechanism 3, which has paper supply cassettes 3*a* and 3*b* to supply sheets of paper P that are the transfer material to an image forming unit 2 that is an image forming portion in a main body 8 that is a main body of apparatus. Further, the copier 10 mounts a manual paper supply mechanism 4, which has a pickup roller 4*b* to take out sheets of paper P from a paper supply tray 4*a* and, a manual separation/conveying unit 4*c* to separate and convey the took out sheets of paper P. Further, the copier 10 mounts a reversing/conveying 5 to reverse sheets of paper P when forming images on both sides of the sheets.

A scanner unit 6 is mounted on the upper surface of the copier 10 to read document images. The scanner unit 6 mounts a document glass 61, which documents are placed, an optical system unit 63 to focus the reflecting light from documents, and a CCD scanner unit 64 to read the light from the optical system unit 63. A finisher 9 that is an optional unit can be mounted at the paper exhaust side of the copier 10.

Figure 2:
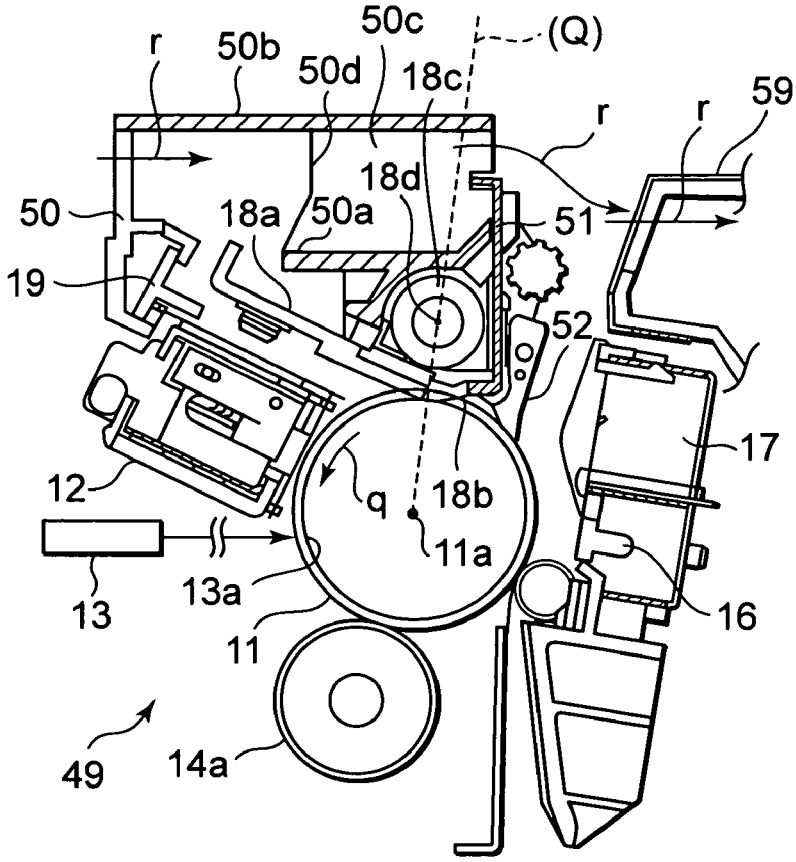
FIG. 2 is a schematic construction diagram showing a part of an image forming unit in the embodiment of the present invention.

As shown in FIG. 2, an image forming unit 2 that is an image forming means, around a photosensitive drum 11 that is an image carrier, has a main charger 12 for uniformly charging a photosensitive drum 11 sequentially according to the rotation of the photosensitive drum 11 in the direction of the arrow q. Further, the image forming unit 2 has a laser exposure unit 13 to form latent images based on image data from the scanner unit 6 by exposing the light from the laser exposure unit 13 on an exposing part 13*a* of the charged photosensitive drum 11. Further the image forming unit 2 has a developing unit 14, a transfer charger 16, a separation charger 17, a cleaner 18 that is a toner recovery unit, and a discharging LED 19.

The developing unit 14 is of conventionally known magnetic brush type to make the development using a two-component developer comprising toner and carrier. The developing unit 14 has a developing roller 14*a* and a conveying auger 14*b*. The toner, which heat resisting temperature is 45° C. for example, is supplied from a toner cartridge 53 to the developing unit 14 according to toner density in the two-component developer. A developing bias value of the developing roller 14*a* is set at about −360V at the reference environment (room temperature 23° C., humidity 50%). But the developing bias value is adjustable accordingly to an environment of humidity. For example, the developing bias value is set at about −390V at in the dry condition and about −310V at in the high humid condition.

For example, the bias value of the main charger 12 is adjustably set to −495V+10/−45V, that of the transfer charger 16 is adjustably set to about 480 μA+60/−140 μA or that of the separation charger 17 is adjustably set to 70 μA−25/−35 μA, respectively.

The cleaner 18 has a cleaning blade 18*a* and a recovery blade 18*b* to scrape off residual toner on the photosensitive drum 11 after passing the transfer charger 16. Further, the cleaner 18 has a recovery auger 18*c* that is an auger to convey recovered toner scraped by cleaning blade 18*a* to a recovery box (not shown).

Figure 4:
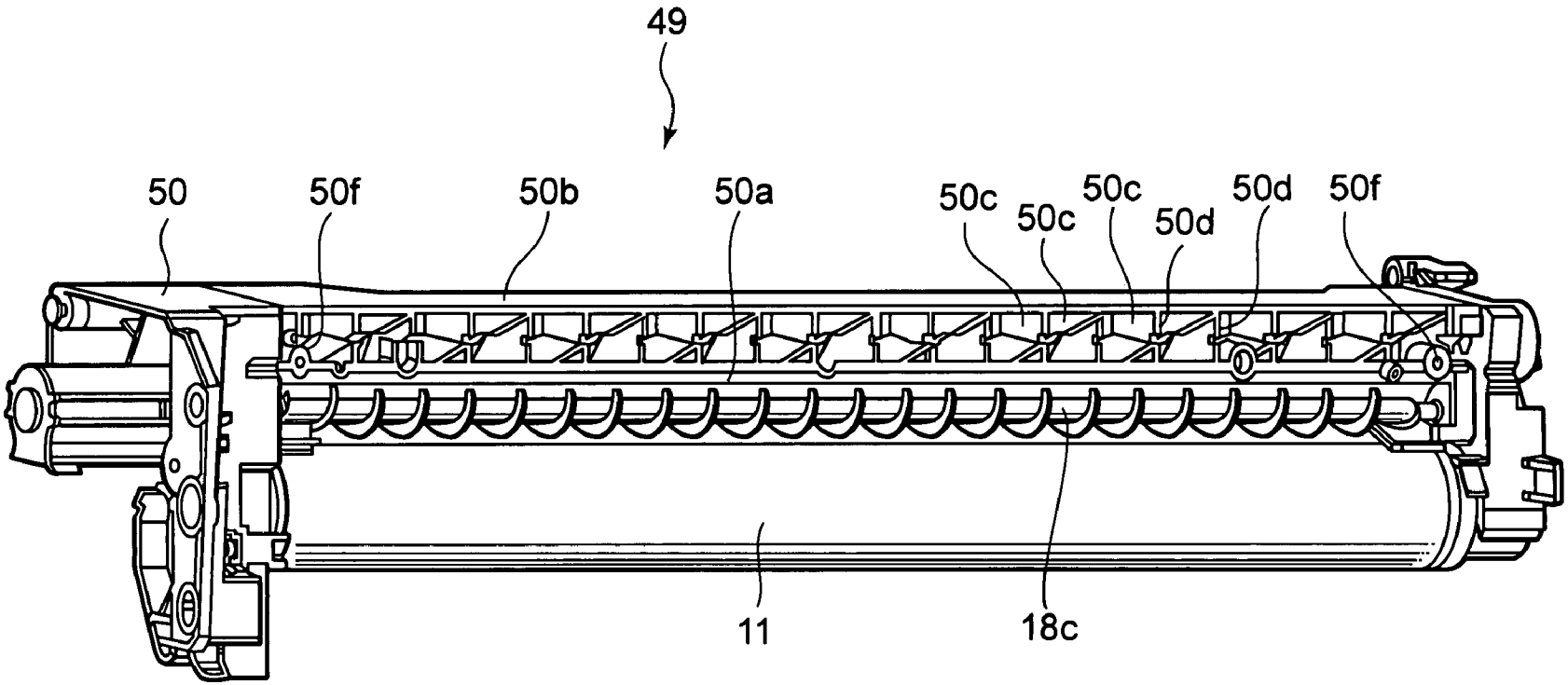
FIG. 4 is a schematic perspective view of an image forming unit in the state with a plate cover removed viewed from an exhaust port in the embodiment of the present invention.
Figure 5:
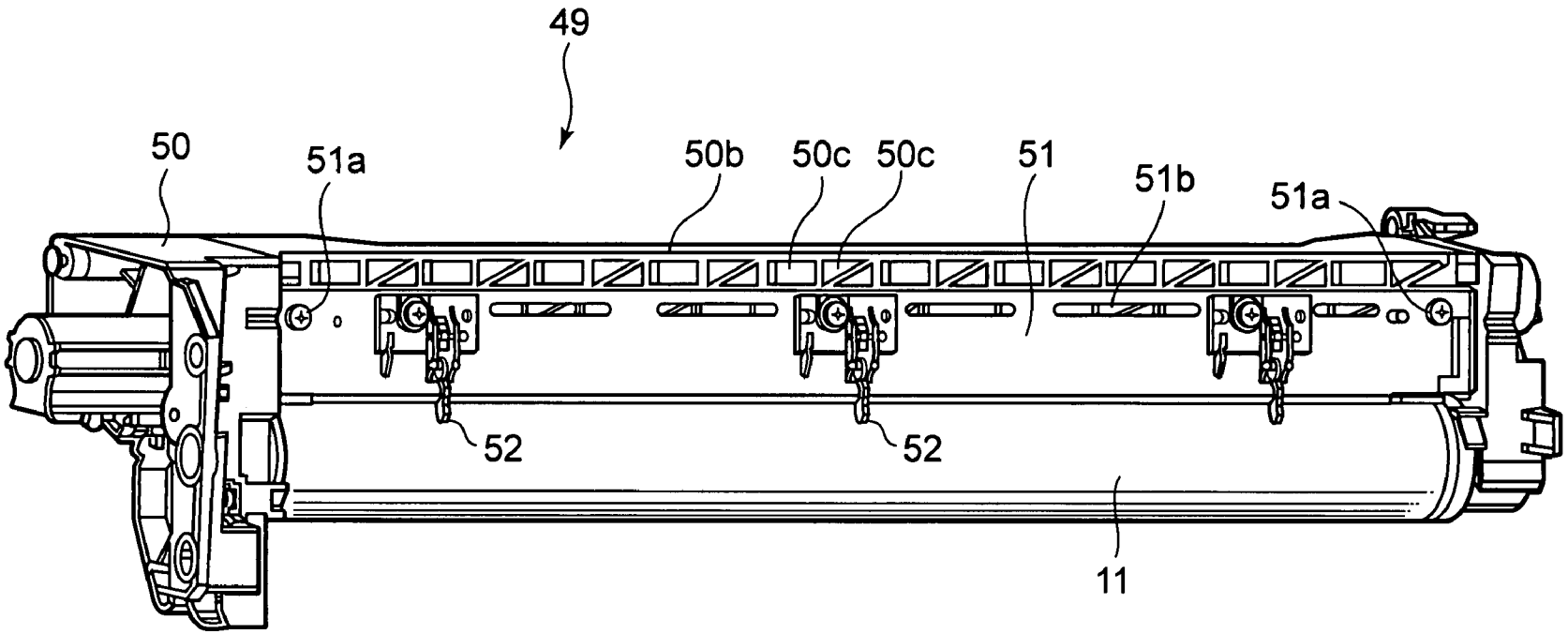
FIG. 5 is a schematic perspective view of an image forming unit viewed from the exhaust port in the embodiment of the present invention.

The photosensitive drum 11, the main charger 12, the developing unit 14, the cleaner 18 and the discharging LED 19 are housed in one unit as an image forming unit 49 that is a process cartridge. The image forming unit 49 shown in FIG. 4 and FIG. 5 can be installed/removed to/from the copier 10 and it is installed/removed from the front side of the main body 8 of the apparatus when exchanging it.

Above the image forming unit 2, a fixing unit 22, for clamping and conveying the sheet of paper P by a heat roller 20 having a built-in heater lamp 20*a* and a press roller 21 is provided. The fixing unit 22 holds a fixing temperature of about 170~180° C. and, heats, press and fix a toner image. At the downstream in the sheet of paper P conveying direction of the fixing unit 22, paper discharge rollers 24 are provided to discharge sheets of paper P in a paper receiving tray 23 after fixing an image. Further, above the paper discharge rollers 24, a heat radiation plate 25 is provided.

On a conveying path 7 extending from the paper supply cassettes 3*a*, 3*b* to the image forming unit 2, pick-up rollers 30*a*, 30*b* to take out sheets of paper P, separation/conveying units 31*a* and 31*b*, conveying roller 32 and alignment roller 33 are mounted.

Figure 3:
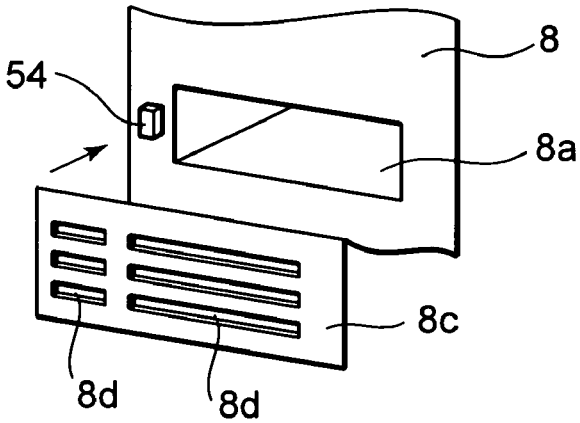
FIG. 3 is a schematic perspective view showing an inlet port in the embodiment of the present invention.

Above the laser exposure unit 13, a suction duct 56 is provided to lead the air from an inlet port 8*a* of the main body 8. At the middle space of the suction duct 56, the first fan 57 that is a blowing member to take in the air is provided. At the side opposite to the inlet port 8*a* of the main body 8, the exhaust port 8*b* is provided to exhaust the air in the main body 8 and lead to an exhaust duct 59 to the outside. At the exhaust port 8*b*, the second fan 58 that is a blowing member to exhaust the air in the main body 8 is mounted. Further, on the outer wall of the main body 8 and around the inlet port 8*a*, an environmental sensor (a temperature/humidity sensor) 54 is mounted to detect temperature and humidity of the operating environment of the copier 10. As shown in FIG. 3, the inlet port 8*a* and the environmental sensor 54 are protected by an outer cover 8*c* having slits 8*d*.

In the main body of the apparatus, a one-way airflow in an arrow direction r toward the exhaust port 8*b* from the inlet port 8*a* is generated by the first fan 57 and the second fan 58. The environmental sensor 54 is located at the passage to take the air from the inlet port 8*a* and is away from the fixing unit 22. Therefore, the environmental sensor 54 can always detect the operating environment of the copier 10 correctly without affects by temperature/humidity in the main body 8. Further, the outer wall of the main body 8 which is provided the finisher 9 that is an optional unit, is not suited for mounts the environmental sensor 54, when a finisher is used. However, the around the inlet port 8*a*, the environmental sensor 54 can detects the operating environment of the copier 10 without affects by the finisher 9. Because the around the inlet port 8*a*, an airflow to take in the air is generated.

The image forming unit 49 is arranged at a position to block the airflow in the arrow direction r in the main body 8. Therefore, on a unit frame 50 of the image forming unit 49, a junction duct 50*c* is formed to flow the air in the arrow direction r so as to flow the air without interrupting the passage. The unit frame 50 will be described below in detail. The unit frame 50 is made of resin about 2 mm thick. On the upper surface of a cleaner frame 50*a*, which houses the cleaner 18 of the unit frame 50, a reinforced frame 50*b* that is a pouched reinforced portion is provided for enforcing the unit frame 50. The reinforced frame 50*b* has many of ribs 50*d*, which shaped parallel walls for making the punched area and reinforcing the unit frame. The ribs 50*d* partition the inside of the junction duct 50*c*.

The side surface of inlet port 8*a* of the reinforced frame 50*b* and the side surface of exhaust port side 8*b* of the reinforced frame 50*b* are kept open. The cleaner frame 50*a* and the reinforced frame 50*b* comprise the junction duct 50*c*. The pouched area in the junction duct 50, which fenced by the cleaner frame 50*a* and the reinforced frame 50*b* is the airflow passage in the arrow direction r extending from the inlet port 8*a* to the exhaust port 8*b* in the main body 8. The ribs 50*d* inside of the junction duct 50*c* control the airflow direction in the main body 8.

The junction duct 50*c* is arranged to flow the air in the vertical direction against the plane surface (Q). The plane surface (Q) includes a rotary shaft 11*a* of the photosensitive drum 11 and a rotary shaft 18*d* of the recovery auger 18*c*. That is, the airflow in the arrow direction r in the inside of the junction duct 50*c* is vertical to the plane surface (Q).

The surface of the cleaner, which arranged opposite to the separation charger 17 is not covered by a thick resin. A sheet metal cover 51 in about 0.8 mm thick is directly attached the surface of the cleaner to support the recovery blade 18*b*. The sheet metal cover 51 is a part of the cleaner frame 50*a*. Thus, a wider space can be secured between the cleaner frame 50*a* and the separation charger 17 by constructing the cleaner frame 50*a* as described above.

Both ends of the sheet metal cover 51 are screwed into thread holes 50*f* formed on the cleaner frame 50*a* by screws 51*a*. The sheet metal cover 51 is partially extended to the area of the junction duct 50*c* to maintain the cleaner 18 airtight and adiabatic. Therefore, at a part of the area of the sheet metal cover 51, which extend to the junction duct 50*c*, a slit 51*b* is formed to improve conductivity of the air flowing in the junction duct 50*c*. Further, separation claws 52 to separate the edge of a sheet of paper P from the photosensitive drum 11 are screwed to the sheet metal cover 51.

Next, the operation of the present invention will be described. When the image forming process starts, the first fan 57 and the second fan 58 are driven, and a document is read by the scanner 6. In the image forming unit 2, the photosensitive drum 11 is turned in the arrow direction q. The photosensitive drum 11 uniformly charged by the main charger 12 and then, an electrostatic latent image is formed thereon by applied with the laser beam corresponding to a document image by the laser exposure unit 13. Then, the electrostatic latent image is developed by the developing unit 14 and a toner image is formed on the photosensitive drum 11. At this time, the charging bias value or the developing bias value of the developing unit 14 when a toner image is formed is set up according to the result of detection by the environmental sensor 54, respectively.

On the other hand, in the cassette mechanism 3 or the manual paper supply mechanism 4, prescribed sheets of paper P are taken out by pick-up rollers 30*a*, 30*d* or pick-up roller 4*b*. The sheets of paper P taken out are separated to one by one when passing through separation/conveying unit 31*a*, 31*b* or the manual separation/conveying unit 4*c*. And the sheets of paper P sent to the position of the transfer charger 16 in sync with a toner image on the photosensitive drum 11 by alignment rollers 33 through the conveying roller 32, and the toner image on the photosensitive drum 11 is transferred on to the sheets of paper P.

Then, the sheets of paper P are peeled off from the photosensitive drum 11 by the separation claw 52 and the separation charger 17 and then, inserted between the heat roller 20 and the press roller 21 of the fixing unit 22, and the toner image is heated, pressed and fixed and the paper is discharged in the paper receiving tray 23. The toner images on the sheets of paper do not come in contact with the separation claw 52, when the sheets of paper are separated from the photosensitive drum 11 and conveyed to the fixing unit 22, because the space between the cleaner frame 50*a* and the separation charger 52 are formed wide. Bias values of the transfer charger 16 and the separation charger 17 are set up according to the result of detection by the environmental sensor 54, respectively.

After completing the transfer, the photosensitive drum 11 is cleaned residual toner by the cleaner 18, is removed the residual charge by the discharging LED 19, and waits for the next image forming process. The cleaner 18 scrapes the recovered toner scraped from the photosensitive drum 11 by the blade 18*a* through the recovery blade 18*b*, and then conveys the recovered toner in the direction of a recovery box (not shown) by the recover auger 18*c*. The recovered toner in the recovery box is provided for the recycle.

While the image forming process described above is executed, radiant heat from the fixing unit 22 is radiated through the upper radiation plate 25 and radiated to the outside of the main body 8 by the airflow generated by the driving of the first fan 57 and the second fan 58 in the arrow direction r. That is, the airflow in the arrow direction r by taking the outside air from the inlet port 8*a* by the first fan 57 passes through the suction duct 56, is blown against the toner cartridge 53 to cool it down. Then, the airflow reaches the image forming unit 49 by flowing around the toner cartridge 53, and is led to the exhaust duct 59 after passing through the junction duct 50*c* formed above the unit frame 50, and exhausted to the outside of the main body 8 through the exhaust port 8*b* by the second fan 58.

As a result, a space between the fixing unit 22 and the image forming unit 49 is blocked by the air curtain of the airflow in the arrow direction r. Accordingly, the radiant heat of the fixing unit 22 is directly exhausted to the outside of the main body 8 without flowing in the direction to the image forming unit 49 or the toner cartridge 53. Thus, the temperature rise of the image forming unit 49 when the image forming process is repeated can be suppressed to the max. 9° C. even at the position of the cleaner 18 that is most close to the fixing unit 22 by the airflow in the arrow direction r reaching the exhaust port 8*b* from the inlet port 8*a* through the suction duct 56, the junction duct 50*c* and the exhaust duct 59.

As a result, the temperature of the recovered toner, which recovered by the cleaner 18 does not rise to max. 39° C. even when the copier 10 was used at a room temperature 30° C. Therefore, the recovered toner is not deteriorated when heated and the satisfactory developing characteristic suited to the recycle use is maintained. Further, the photosensitive characteristic of the photosensitive drum 11 is not deteriorated and a satisfactory image is obtained.

According to this embodiment, as a result of the upper portion of the unit frame 50 made to the junction duct 50*c*, it becomes possible to block the space between the fixing unit 22 and the image forming unit 49 by the airflow regardless of a short distance between the fixing unit 22 and the image forming unit 49. Accordingly, the radiant heat from the fixing unit 22 is directly exhausted from the exhaust port 8*b* without directing toward the direction of the image forming unit 49. Further, it is possible to always blow the open air taken through the inlet port 8*a* against the toner cartridge 53 and the image forming unit 49 by the airflow in the arrow direction r generated in the main body 8.

Accordingly, it is possible to positively cool the toner cartridge 53 and the image forming unit 49. Thus, the temperature rise of the toner cartridge 53 or the image forming unit 49 by the fixing unit 22 can be prevented without impairing the downsizing of the apparatus. That is, the characteristics of the photosensitive drum 11 can be prevented from being deteriorated by heating and the image quality can be improved. Furthermore, the supply toner of the toner cartridge 53 or recovered toner by the cleaner 18 is deteriorated by heat can be prevented, and good supply toner is obtained or the recycling use of recovered toner can be achieved.

Further, according to this embodiment, the sheet metal cover 51 that supports the recovery blade 18*b* is attached directly to the cleaner frame 50*a* as a part of the cleaner frame 50*a*. Accordingly, it becomes possible to make the conveying path of paper P extending from the separation charger 17 to the fixing unit 22 wide, and to prevent a toner image from being disturbed by sheets of paper P touching the separation claw 52.

Further, according to this embodiment, because the environment sensor 54 is mounted on the flow path for taking in the air around the inlet port 8*a*, it becomes possible to get the more accurate using environment and the main charger 12, the developing roller 14*a*, the transfer charger 16 or the separation charger 17 become accurately adjustable according to the environment and thus it becomes possible to improve the image quality.

Further, the present invention is not restricted to the embodiment described above but can be modified variously within the scope of the present invention. For example, the structure of the junction duct is not restricted provided that it is able to conduct the airflow between the image forming unit and the fixing unit. The junction duct may be separated from the unit frame; however, a part of the unit frame is used as the junction duct shown in the embodiment, the space is further saved and the image forming apparatus can be made smaller in size. Further, when a part of the unit frame is used as the junction duct, the strength of the unit frame is increased and the component elements of the image forming unit can be arranged more accurately.

Further, the direction of airflow in the main body of the apparatus is not restricted provided that the radiant heat of the fixing unit is exhausted more efficiently. However, when a toner cartridge is arranged at the upper stream than the fixing unit, and the open air is blown against it as shown in the embodiment, a toner cartridge is more efficiently cooled down. Accordingly, the supply toner is prevented from being heated and its life can be extended.

Further, the image forming apparatus is in an optional structure and can be a color image forming apparatus with a plurality of image forming units containing developing units in different color toners arranged on a sheet conveying path. In the case of such a color image forming apparatus, radiant temperature of the fixing unit can be exhausted to the outside of the apparatus by providing a junction duct between the highest image forming unit that is most close to the fixing unit. Further, although a heat resisting temperature of the image forming apparatus or that of the toner is optional, a fixing temperature can be lowered when the toner of lower heat resisting temperature is used, and the influence by radiant heat of the fixing unit can be lowered. Further, the position of the sensor is also optional provided that it is not affected by temperature/humidity in the main body of the apparatus. The position of the sensor can be near the suction port because new open air is always taken in and more accurate environment can be detected. When near the suction port, a sensor may be arranged in the inside of the duct.

According to the present invention as described above in detail, the radiant heat of the fixing unit can be efficiently exhausted directly to the outside of the main body of the apparatus in the downsized state, without enlarging a space reaching the fixing unit from an image carrier, and efficiently cooling the inside of the apparatus. Accordingly, it becomes possible to prevent temperature rise of the image carrier and the toner recovery unit, improve image quality and achieve the recycle use of recovered toner.

What is claimed is:

1. An image forming apparatus, comprising:

a main body of the apparatus;

an image carrier mounted in the main body of the apparatus;

an image forming portion to form a toner image on the image carrier;

a transfer unit to transfer the toner image formed on the image carrier to transfer material;

a toner recovery unit to recover residual toner on the image carrier after passing the transfer unit;

a fixing unit to fix the toner image on the transfer material provided above the image forming unit and the toner recovery unit, wherein at least the image carrier and the toner recovery unit are housed integrally in a unit frame;

a blowing member to generate the airflow; and a junction duct provided between the toner recovery and the fixing unit and flow the airflow from the inlet port to the exhaust port of the main body, wherein the junction duct comprises the unit frame, and wherein the junction duct also serves as a pouched reinforced portion of the upper part of the unit frame.

2. The image forming apparatus according to claim 1, wherein a toner cartridge is further provided to supply toner to the image forming portion, and mounted at the upper stream side of the airflow than the junction duct in the main body of the apparatus.

3. The image forming apparatus according to claim 1, wherein a sensor is provided near the inlet port of the main body of the apparatus at least to detect temperature and humidity of open air.

4. An image forming apparatus, comprising:

a main body of the apparatus;

an image carrier mounted in the main body of the apparatus;

an image forming portion to form a toner image on the image carrier;

a transfer unit to transfer the toner image formed on the image carrier to transfer material;

a toner recovery unit to recover residual toner on the image carrier after passing the transfer unit;

a fixing unit to fix the toner image on the transfer material provided above the image forming unit and the toner recovery unit, wherein at least the image carrier and the toner recovery unit are housed integrally in a unit frame;

a blowing member to generate the airflow; and a junction duct provided between the toner recovery and the fixing unit and flow the airflow from the inlet port to the exhaust port of the main body, wherein the junction duct comprises the unit frame, and wherein a surface of the unit frame is formed with a sheet metal extending to an area of the junction duct and opposing the transfer unit across from a conveying path of the transfer material.

5. The image forming apparatus according to claim 4, wherein the sheet metal supports a separation claw to separate the transfer material from the image carrier.

6. A process cartridge, comprising:

an image carrier;

a toner recovery unit that has an auger to recover residual toner from the image carrier; and a junction duct provided adjacently to the toner recovery unit and flow an airflow in a direction crossing a plane surface including a rotary shaft of the image carrier and a rotary shaft of the auger, wherein at least the image carrier and the toner recovery unit are housed integrally in a unit frame and the junction duct comprises a part of the unit frame, and wherein the junction duct also serves as a pouched reinforced portion of the upper part of the unit frame.

* * * * *